US006286816B1

(12) United States Patent
Liebig et al.

(10) Patent No.: US 6,286,816 B1
(45) Date of Patent: Sep. 11, 2001

(54) CHAIN HOIST

(75) Inventors: Karl Liebig, Wetter; Oliver Moll, Solingen; Michael Schubert, Hemer, all of (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/422,902

(22) Filed: Oct. 21, 1999

(30) Foreign Application Priority Data

Nov. 5, 1998 (DE) ..... 198 52 538

(51) Int. Cl.[7] ..... B66D 1/00

(52) U.S. Cl. ..... 254/277; 254/372; 254/382; 254/397

(58) Field of Search ..... 254/277, 362, 254/372, 382, 387, 392, 394, 397

(56) References Cited

U.S. PATENT DOCUMENTS

| | | | | |
|---|---|---|---|---|
| 2,240,523 | * | 5/1941 | Schramm | 254/362 |
| 2,245,057 | * | 6/1941 | Schramm | 254/362 |
| 2,294,222 | * | 8/1942 | Brongersma | 254/362 |
| 2,656,150 | * | 10/1953 | Lock | 254/372 |
| 2,778,506 | * | 1/1957 | Harry | 254/277 |
| 4,165,863 | * | 8/1979 | Schreyer | 254/277 |

FOREIGN PATENT DOCUMENTS

| | | | | |
|---|---|---|---|---|
| 34 42 868 A1 | | 6/1986 | (DE) . | |
| 93 17 630 U1 | | 4/1994 | (DE) . | |
| 197 16 411 C1 | | 8/1998 | (DE) . | |
| 211438 | * | 3/1967 | (SE) | 254/362 |
| 647224 | * | 2/1979 | (SU) | 254/277 |

* cited by examiner

*Primary Examiner*—Emmanuel M. Marcelo
(74) *Attorney, Agent, or Firm*—Henry M. Feiereisen

(57) ABSTRACT

A chain hoist, includes a chain which is trained over first and second sprockets defining a movement path for the chain, with the first sprocket being connected to a load-bearing member, and with the second sprocket being part of a drive unit for operating the chain. In order to effectively prevent chain vibrations caused by the so-called polygon effect, the chain hoist includes a damping unit which is positioned in the movement path of the chain for damping vibration.

10 Claims, 7 Drawing Sheets

20
21
22
13
II
25
23
19
24a
27
24c
14
24
12b
26a
26
12
24b
15
II
18a
11a
12a
9
10
16
17
18
11

CHAIN HOIST

CROSS-REFERENCES TO RELATED APPLICATIONS

This application claims the priority of German Patent Application Serial No. 198 52 538.9, filed Nov. 5, 1998, the subject matter of which is incorporated herein by reference.

BACKGROUND OF THE INVENTION

The present invention relates, in general, to a chain hoist, and more particularly to a compact chain hoist of a type including a chain which is guided via at least one sprocket for connection to a load-bearing member, and a drive unit having a housing which accommodates a driveshaft for support of a sprocket to drive the chain.

It is generally known in the field of chain hoists or chain blocks that chain vibrations in longitudinal and transverse directions are generated as a consequence of the so-called "polygon effect". The degree of vibration existing in a chain hoist is related to the natural frequency of the chain and the frequencies being imposed on the chain during operation of the chain hoist. The oscillation frequency is thereby dependent on the lift velocity and the chain pitch, whereas the degree of encountered accelerations depends on the lift velocity as well as on the number of teeth of the sprockets. It is also known that accelerations upon several deflections cumulate longitudinally in the direction of the chain substantially at the individual sprockets.

German Pat. No. DE 93 17 630 U1 discloses a chain drive provided with a polygon damping device which includes a resiliently mounted and rotatable carrier roller by which the return strand of the chain is supported. The carrier roller is provided with elastic material so as to realize a damping of oscillations, whereas the resilient support of the carrier roller is implemented by a hydraulic unit.

German Pat. No. DE 197 16 411 C1 describes a chain drive, in particular for an auxiliary drive of internal combustion engines, by which excitations of the endless chain as a consequence of the polygon effect are substantially reduced by using a mass damper in the form of a flywheel in one of both sprockets. The mass damper is shiftable essentially radially elastically and swingably mounted in the direction of the connecting line of both sprocket shafts linked together by the chain, for damping of oscillation.

These types of chain drives, described in German Pat. Nos. DE 93 17 630 U1 and 197 16 411 C1 are concerned with endless chains with a pulling chain strand and a returning idle strand, and are unsuitable for incorporation in a chain hoist having a chain which is fixed at one end to the chain hoist.

SUMMARY OF THE INVENTION

It is thus an object of the present invention to provide an improved chain hoist, obviating the afore-stated drawbacks.

In particular, it is an object of the present invention to provide an improved chain hoist which effectively eliminates chain oscillations as a result of the polygon effect, in particular in conjunction with compact chain hoists having several chain deflections.

These objects, and others which will become apparent hereinafter, are attained in accordance with the present invention by training a chain over first and second sprockets for defining a movement path for the chain, with one of the sprockets being connected to a load-bearing member, and the other one of the sprockets being part of a drive unit for operating the chain, and by providing a damping unit which is positioned in the movement path of the chain for damping vibration.

In the practice of the invention, the damping unit can be incorporated in the chain hoist in a variety of ways and locations. According to one embodiment of the present invention, the damping unit is so incorporated in the movement path of the chain as to support at least one of the first and second sprockets on the chain hoist. This configuration of the chain hoist can be realized in a simple manner to effect a damping of vibrations and/or prevention of a chain with continuously alter nating loads, in particular a damping of vibrations in longitudinal direction of the chain as a consequence of dilatation. Resonance is prevented, without need for changing the excitation frequency based on the lift velocity, by simply lowering the natural frequency of the entire system Thus, the chain hoist can be operated in the supercritical range, i.e. above the natural frequency of the chain hoist because through these measures the natural frequency is reduced. As a result, undesired noise generation caused by strong vibrations in case of resonance are eliminated.

According to another feature of the present invention, the guidance of the components interconnected via the damping unit can be realized in a simple and mechanically very stable manner by providing a rocker which supports the at least one of the sprockets, with t he rocker having one end, which is swingably mounted, and another end supported by the chain hoist via the damping unit.

A very compact configuration is realized when securing the rocker to the housing of the drive unit at a location underneath the driveshaft. In this manner, the typically stable housing is used as support frame for the rocker. Moreover, the chain hoist can be retrofitted with such a rocker for damping vibrations, without significantly complicating the overall construction.

Overload of the damping unit at great oscillation amplitudes can be prevented by providing the housing with a stop member to thereby limit the pivot angle of the rocker.

A very compact configuration can further be realized by positioning the pivot axle of the rocker vertically underneath the driveshaft in parallel relationship thereto and in parallel disposition to the axis of the driving sprocket. Thus, the movement path of the chain is directed vertically downwards in this area and advances upwardly following a deflection of the chain by the sprocket of the rocker in a direction away from the pivot axle.

According to another feature of the present invention, the damping unit includes a damper which is securely fixed to the rocker and the housing. Suitably, the rocker is mounted via the damper to the housing and the pivot axle is swingably secured to the housing, to thereby exploit the stability of the housing.

According to another embodiment of the present invention, the housing and the sprocket which is mounted on the driveshaft, and a further sprocket which is positioned downstream in load direction of the chain, may form a structural unit whereby the damping unit is so incorporated in the movement path that the structural unit is supported via the damping unit by a carrier. Thus, the entire drive unit, including the first sprocket, is secured as a whole via the damping unit to the carrier. This is possible because sufficient space is available in this area. Suitably, the carrier is track-bound so that the chain hoist is universally useable.

A stable configuration of this embodiment of the chain hoist, which can be subjected to high loads, is implemented when the structural unit of drive unit and downstream sprocket is supported by a rocker which has one end swingably mounted on the carrier and another end supported by the carrier via the damping unit, whereby the chain, which is guided downwardly via a further sprocket and returned by the sprocket of the load-bearing member, is also secured to the carrier.

According to still another embodiment of the present invention, the damping unit is incorporated in the movement path of the chain such that one end of the chain may be fixed to the chain hoist via the damping unit. This configuration can easily be realized in already constructed chain hoists.

Another embodiment of a chain hoist according to the invention includes the securement of one end of the chain to the load-bearing member via the damping unit. This solution is independent from the configuration of the chain hoist per se. Thus, the load-bearing member is capable to accomplish an effective damping of vibration in a widest variety of chain hoists (preferably at 1/1 fold)

Another embodiment of a chain hoist according to the invention is advantageously employed at 2/1 folds, and involves a chain which is guided via a sprocket of the load-bearing member, with the damping unit so incorporated that the sprocket is supported via the damping unit by the load-bearing member. This is a simple and effective solution for damping vibration of the chain.

Suitably, the damper used in the various embodiments to implement the principle of the present invention may be a metallic pad which exhibits good damping properties. Other examples for a damper include a spring damper or hydraulic damper

BRIEF DESCRIPTION OF THE DRAWING

The above and other objects, features and advantages of the present invention will now be described in more detail with reference to the accompanying drawing, in which.

DETAILED DESCRIPTION OF PREFERRED EMBODIMENTS

Figure 1:
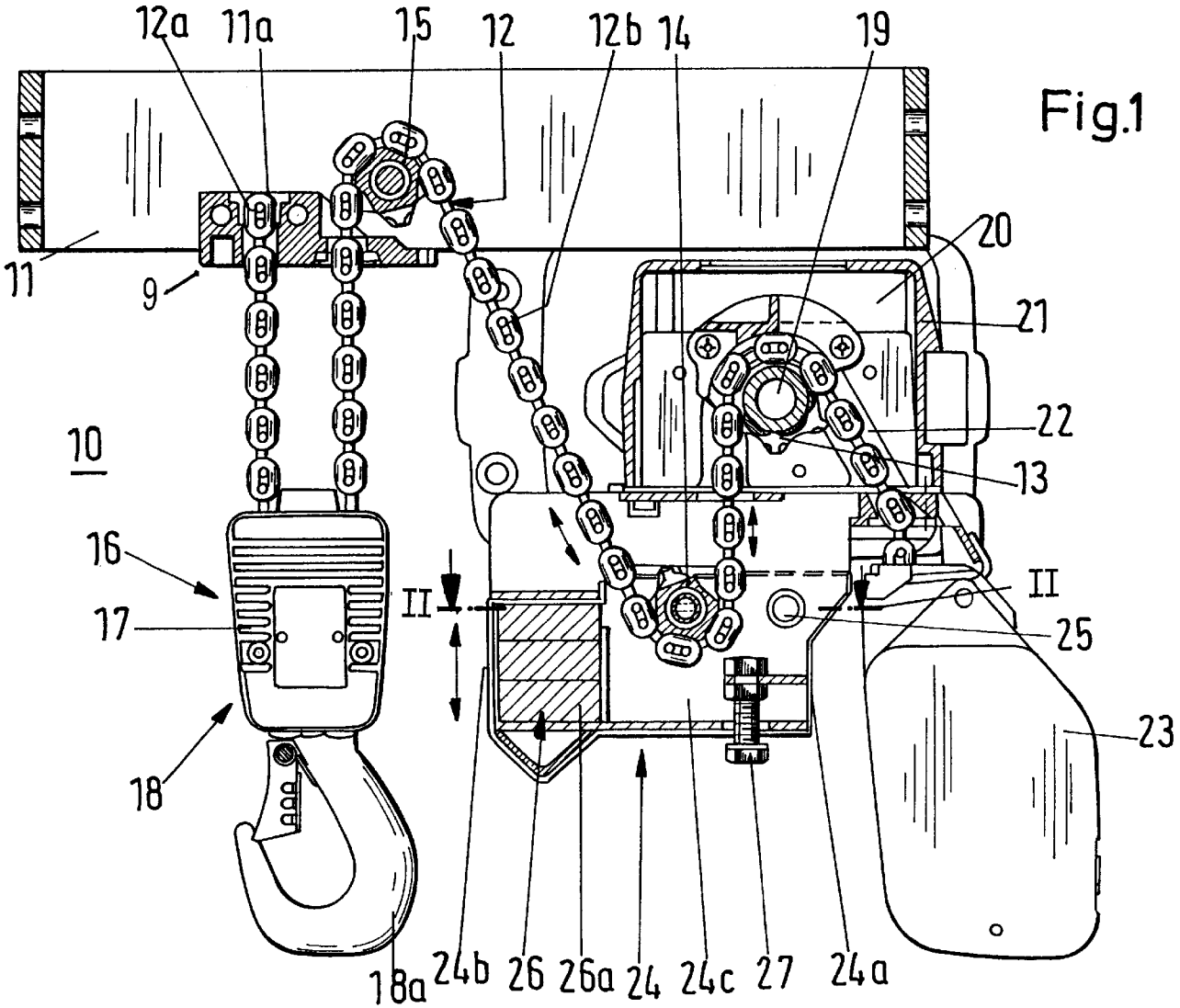
FIG. 1 is a partially sectional view of a first embodiment of a chain hoist according to the present invention.

Throughout all the Figures, same or corresponding elements are generally indicated by same reference numerals.

Turning now to the drawing, and in particular to FIG. 1, there is shown a partially sectional view of a first embodiment of a chain hoist according to the present invention, generally designated by reference numeral 10 and mounted to a movable, e.g. track-bound, carrier 11. The chain hoist 10 includes a strand of a chain 12 which is trained over a plurality of sprockets 13, 14, 15, 16 to define a movement path. The sprocket 16 (FIG. 1*b*) is accommodated in a block casing 17 of a load-bearing member, generally designated by reference numeral 18 and including a load hook 18*a*. The chain 12 is thus connected to the load hook 18*a* and has one end 12*a*, on the left-hand side of FIG. 1, secured to the carrier 11 by a suitable mounting 9 at a point of attachment 11*a*. The other, right-hand, end of the chain 12 is received in a chain receptacle 23.

The sprocket 13 is mounted on a driveshaft 19 which is operated by a drive unit 20. A housing 21 accommodates the drive unit 20 and is secured to the carrier 11.

When lifting a load, the sprocket 13 rotates in clockwise direction to thereby deposit the right-hand chain end via a chain guide 22 in the chain receptacle 23. Thus, the load hook 18*a* with attached load (not shown) is moved upwards so that the section of the chain 12, extending from the point of attachment 11*a* via the sprockets 16, 15, 14 to the sprocket 13 is shortened. A lowering of the load hook 18*a* is effected in reverse direction, resulting in a lengthening of the chain 12 between the point of attachment 11*a* and the sprocket 13.

The chain 12 is made of individual chain links 12*b* so that oscillations are excited longitudinally in the direction of the chain 12 when the chain 12 is moving. This oscillation, caused by the hoist and called "polygon effect", has a frequency which depends on the lift velocity and the pitch of the chain 12, i.e. on the number of chain links 12*b*. The degree of the encountered acceleration is, in turn, dependent on the number of teeth of the sprockets 13, 14, 15, 16 as well as on the lift velocity. The accelerations cumulate when using three deflections (sprockets 14, 15, 16) and are imposed on the chain links 12*b* in longitudinal chain direction at the individual sprockets 13, 14, 15, 16.

In case of resonance, great oscillation amplitudes are encountered when the excitation frequency corresponds to the natural frequency of the chain hoist. The natural frequency of the chain hoist is load-dependent and increases with decreasing load.

Figure 7:
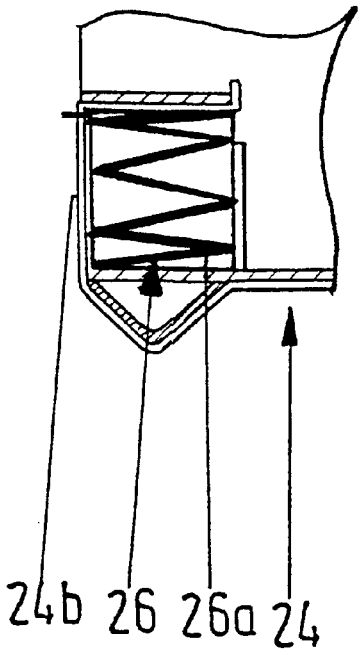
Figure 8:
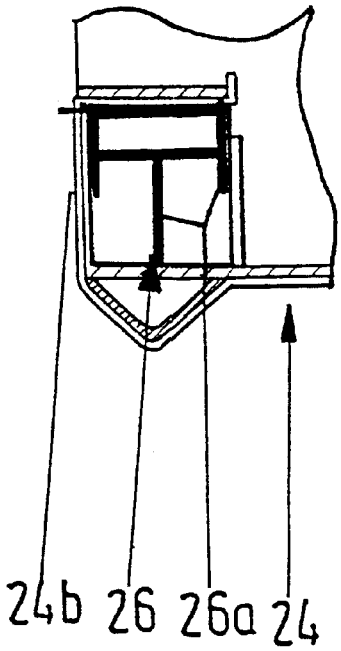

As further shown in FIG. 1, the sprocket 14 is rotatably supported by a frame 24*c* of a structure which is so designed as to form a rocker 24. The rocker 24 has one end 24*a* swingably secured to the chain hoist 10 for rotation about a pivot axle 25, and an opposite end 24*b* supported by the chain hoist 10 via a damping unit 26. Mounted to the housing 21 for limiting the angle of rotation of the rocker 24 is a stop member 27 which prevents an opening or downward tilting of the rocker 24 when no load is attached to the load hook 18*a*. The damping unit 26 includes a damper 26*a* in the form of a metallic pad. The damper 26*a* has a lower end in flat engagement with the rocker 24 and an upper end bearing upon the housing 21. The swingable rocker 24 is thus capable to compress more or less the damper 26*a* to thereby effectively attenuate the oscillation amplitude by converting mechanical energy in heat. Persons skilled in the art will understand that the damper 26*a* may also be formed by an elastomeric damper, spring damper, hydraulic damper or the like as shown by way of examples in FIGS. 7 and 8 which depict in FIG. 7 the provision of a damper 26*a* in the form of a spring damper, and in FIG. 8 the provision of a damper 26*a* in the form of a hydraulic damper.

The rocker 24 is arranged at the housing 21 underneath the driveshaft 19 such that the pivot axle 25 is substantially positioned vertically underneath the driveshaft 19. In this area, the chain 12 is guided vertically downwards. After deflection by the sprocket 14, the chain 12 moves upwardly toward the sprocket 15 at the pivot axle distal side of the sprocket 14, i.e. away from the pivot axle 25 of the rocker 24.

FIG. 1 further shows that the driveshaft 19, the axles of the sprockets 14, 15, 16 as well as the pivot axle 25 extend in parallel relationship to one another. The chain 12 extends substantially in a vertical plane.

Figure 1A:
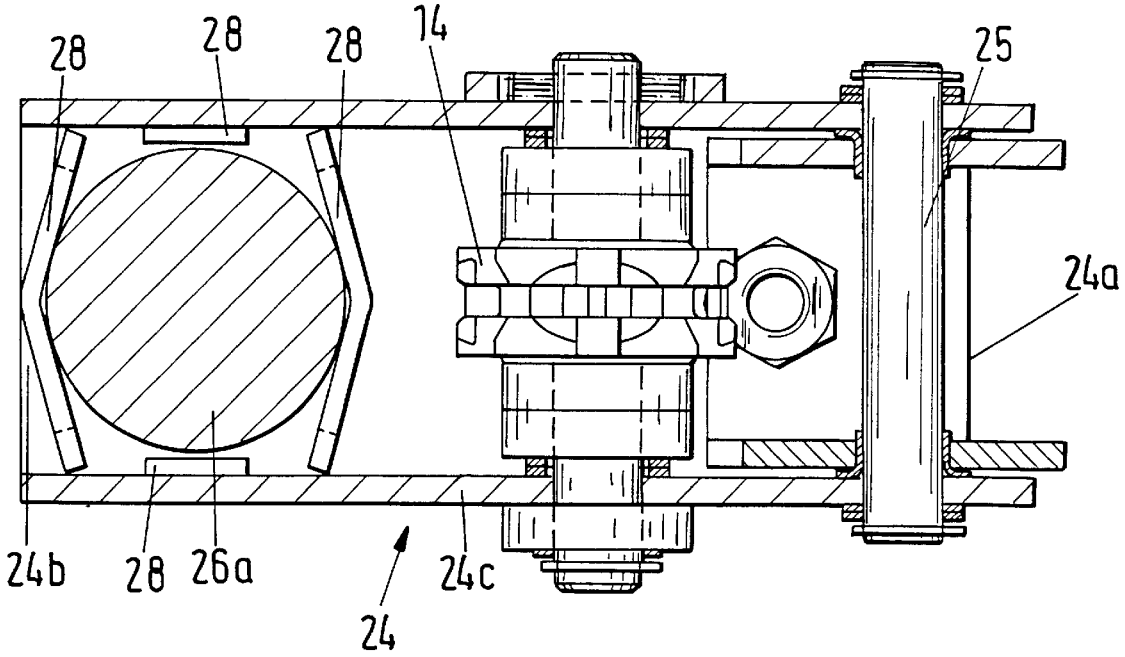
FIG. 1*a* is a cross sectional view of the chain hoist, taken along the line II—II in FIG. 1.

Turning now to FIG. 1*a*, which is a sectional view taken along the line II—II in FIG. 1 without illustration of the chain 12, it can be seen that the damper 26*a* has the shape of a cylinder which rests with its cylindrical surface laterally upon walls 28, without being secured thereto.

Figure 1B:
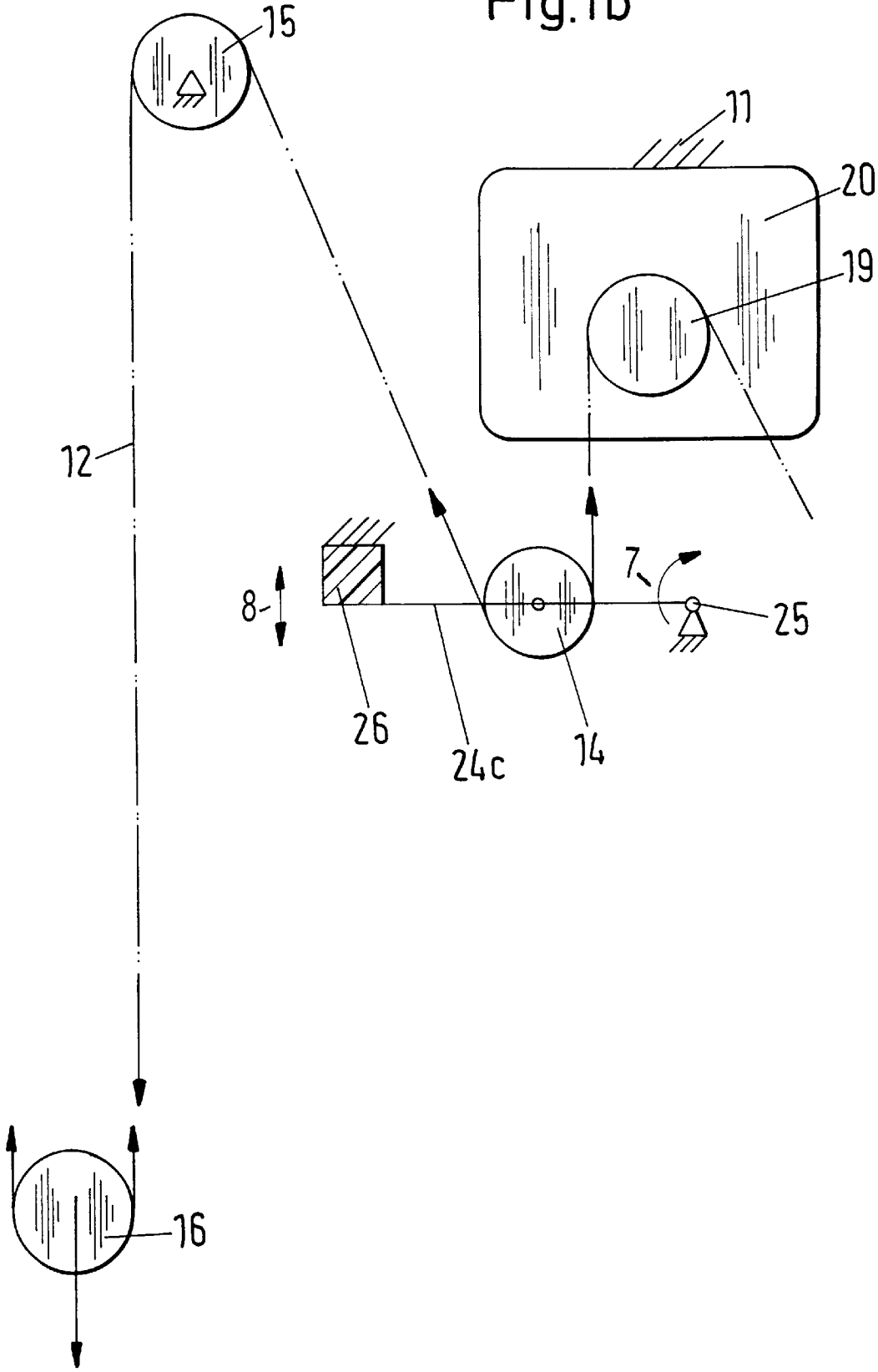
FIG. 1*b* is a schematic illustration of the chain hoist of FIG. 1, illustrating a principal configuration of the chain hoist.

FIG. 1*b* shows schematically the principal configuration of the chain hoist 10 of FIG. 1, depicting encountered tensile forces in the chain 12. The sprocket 14 is supported by the rocker 24 which is rotatable about the pivot axle 25, as indicated by arrow 7, thereby acting upon the damping unit 26 against the stationary housing 21, as indicated by arrow 8. The sprocket 15 is rotatably mounted to the carrier 11 and guides the chain 12 downwardly. Sprocket 16 of the load hook 18*a* deflects the chain 12 again upwardly, with the chain 12 being mounted to the carrier 11 at the point of attachment 11*a*.

Figure 2:
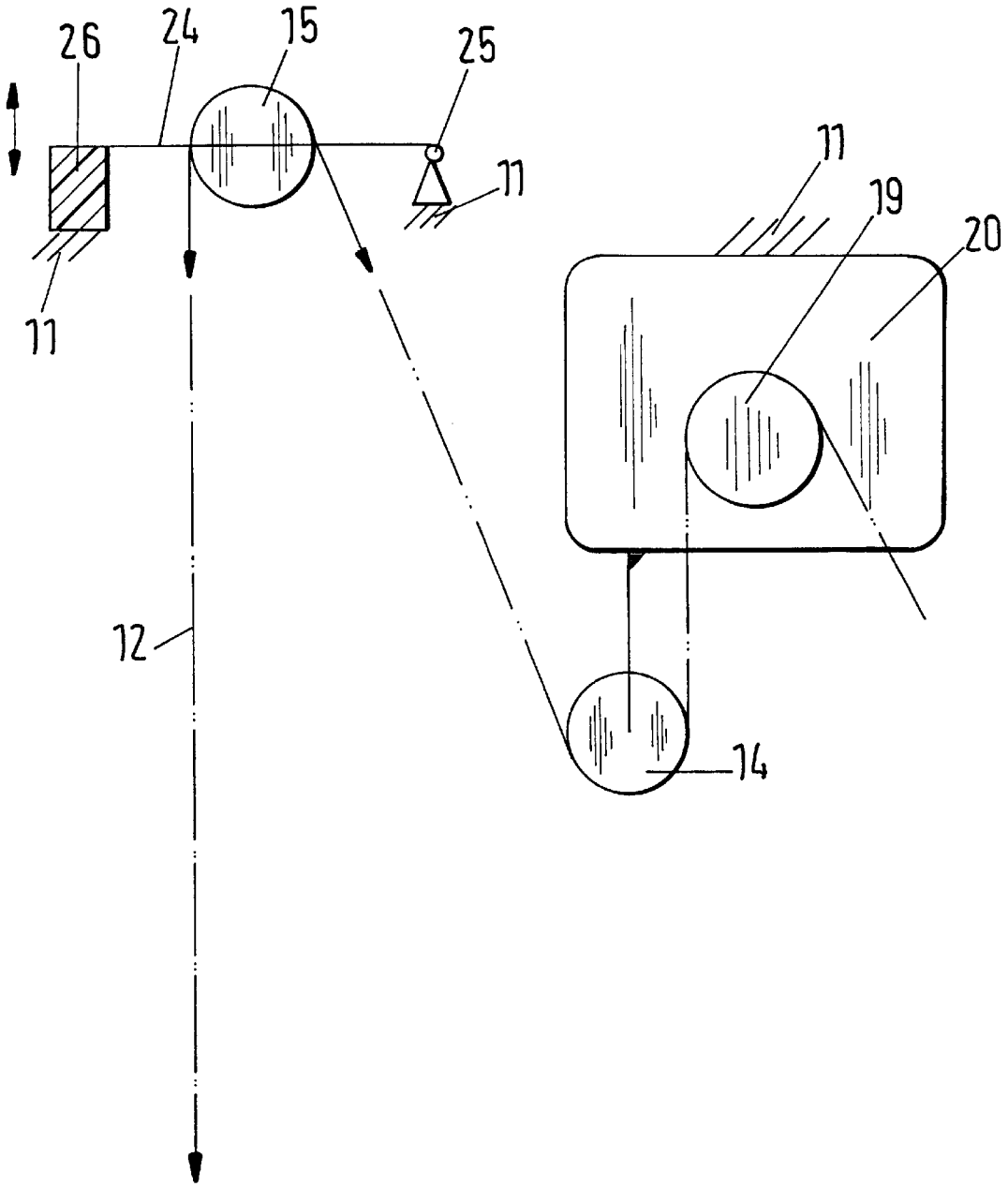
FIG. 2 is a schematic principal illustration of a second embodiment of a chain hoist according to the present invention.

FIG. 2 shows a similar configuration of the chain hoist 10, with the difference with respect to the embodiment of FIG. 1 residing in the fact that the sprocket 15, secured to the carrier 11, is now supported by a rocker 24 which is rotatably mounted to the carrier 11, whereas the sprocket 14 is secured to the housing 21 of the drive unit 20.

Figure 3:
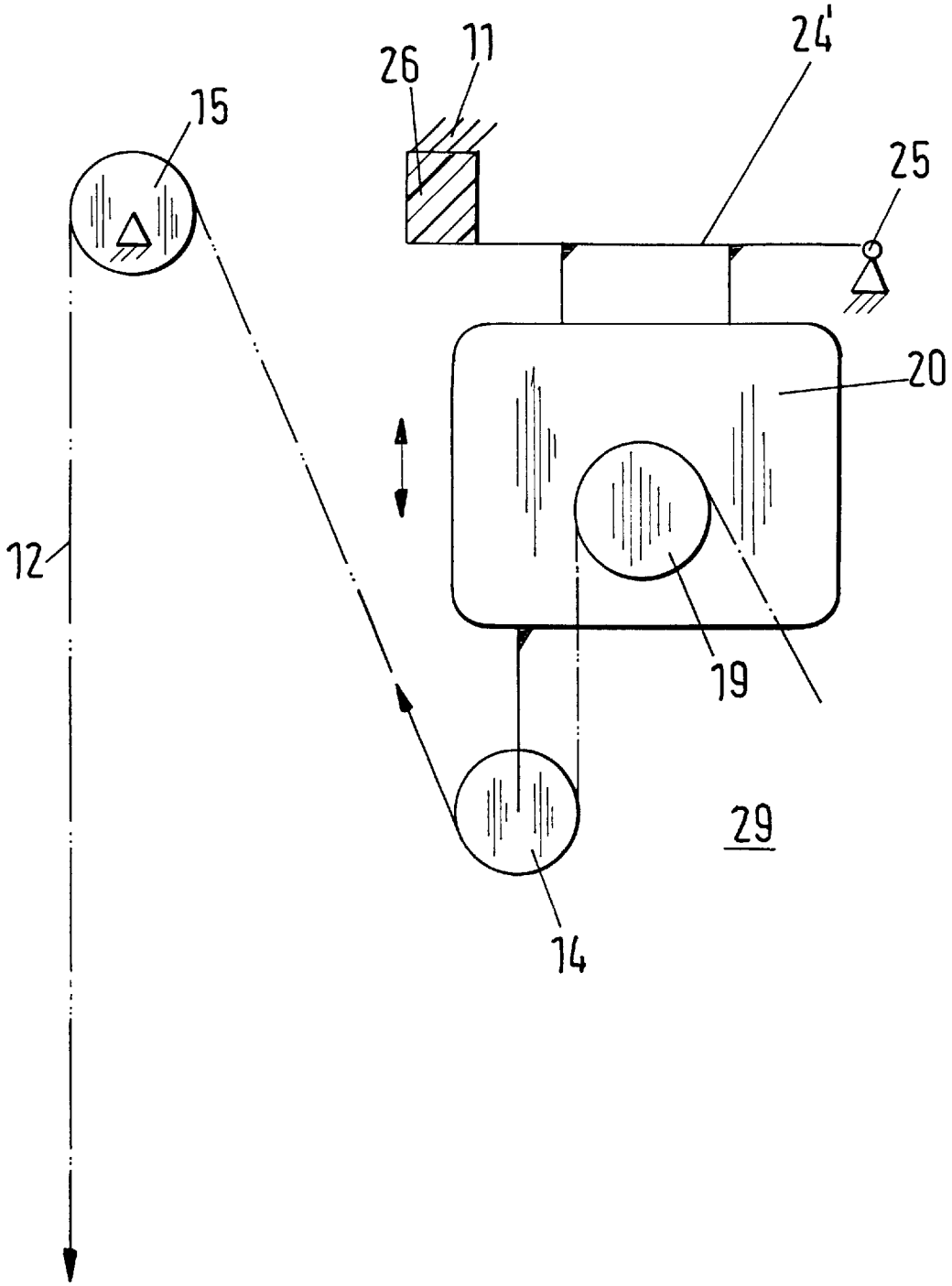
FIG. 3 is a schematic principal illustration of a third embodiment of a chain hoist according to the present invention.

FIG. 3 shows a configuration of the chain hoist 10 in which the housing 21 of the drive unit 20 and the frame 24*c*, which rotatably supports the sprocket 14, are combined to a stationary unit 29 and supported by the carrier 11 via a rocker 24' which has one end swingably mounted to the carrier 11 for rotation about the pivot axle 25 and an opposite end supporting the damping unit 26. The swingable rocker 24' is thus capable, during operation of the chain hoist 10, to compress more or less the damping unit 26, with the structural unit 29 conjointly moving with the rocker 24', to thereby effectively damping vibration. In this configuration, the sprocket 15 is rotatably mounted to the carrier 11.

Figure 4:
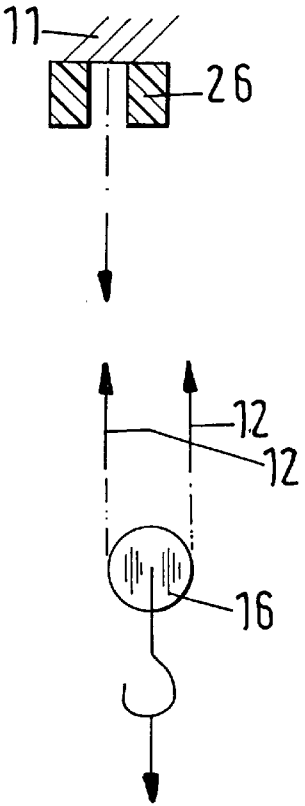
FIG. 4 is a schematic principal illustration of a fourth embodiment of a chain hoist according to the present invention.
Figure 6:
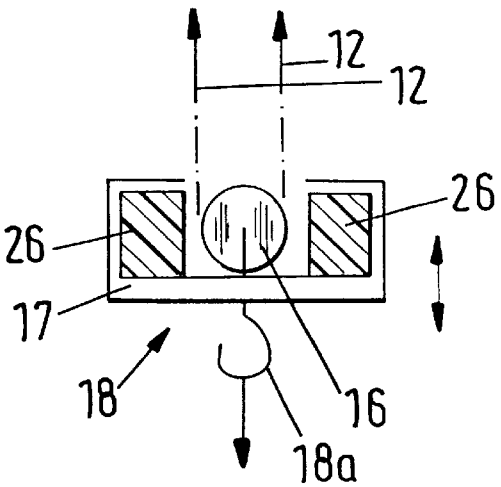
FIG. 6 is a schematic principal illustration of a sixth embodiment of a chain hoist according to the present invention and FIGS. 7 and 8 shows schematic illustrations of exemplified variations of a damping element incorporated in the chain hoist according to the present invention.
Figure 5:
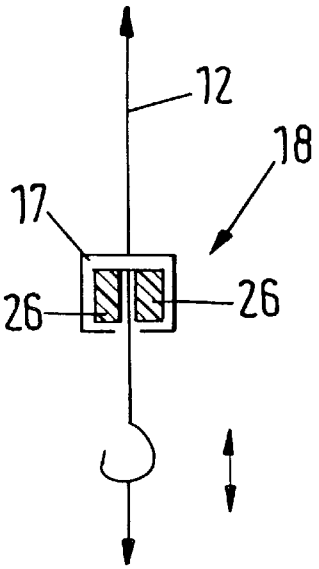
FIG. 5 is a schematic principal illustration of a fifth embodiment of a chain hoist according to the present invention.

Turning now to FIGS. 4 to 6, there are shown variations of chain hoists according to the present invention with integration of a damping unit 26 in the movement path of the chain 12. FIG. 4 shows a configuration of the chain hoist 10 in which the end 12*a* of the chain 12 is secured to the carrier 11 at the point of attachment 11*a* via the damping unit 26. FIG. 5 shows a configuration of the chain hoist 10 in which the chain 12 ends in the block casing 17 of the load-bearing device 18 and is supported therein by the damping unit 26. FIG. 6 shows a configuration of the chain hoist 10 in which the sprocket 16, arranged in the block casing 17 of the load-bearing device 18 (load hook 18*a* ), is supported by the load-bearing device 18 via the damping unit 26.

Persons skilled in the art will understand that the various configurations of the chain hoist, as described above, may also be combined in any suitable manner within a single chain hoist to realize an attenuation of oscillation amplitudes during operation of the chain hoist.

While the invention has been illustrated and described as embodied in a chain hoist, it is not intended to be limited to the details shown since various modifications and structural changes may be made without departing in any way from the spirit of the present invention.

What is claimed as new and desired to be protected by letters patent is set forth in the appended claims:

1. A chain hoist, comprising:

a chain;

a plurality of sprockets for defining a movement path of the chain, said chain being trained over the sprockets, with a first one of the sprockets connected to a load-bearing member, and with a second one of the sprockets being part of a drive unit for operating the chain;

a damping unit positioned in the movement path of the chain for damping vibration;

a carrier; and a rocker for supporting at least one of the plurality of sprockets, said rocker having one end which is swingably mounted for rotation about a pivot axle, and another end supported by the carrier via the damping unit.

2. The chain hoist of claim 1 wherein the drive unit has a housing, which is secured to the carrier, and a driveshaft accommodated in the housing and carrying the second one of the sprockets, said rocker being secured to the housing underneath the driveshaft.

3. The chain hoist of claim 2, and further comprising a stop member secured to the housing for limiting a pivot angle of the rocker.

4. The chain hoist of claim 2 wherein the pivot axle of the rocker is positioned vertically underneath the driveshaft in parallel relation thereto, with the movement path of the chain being directed downwards in a vertical direction in an area between the driveshaft and the pivot axle and deflected upwardly by the at least one of the sprockets which is supported by the rocker.

5. The chain hoist of claim 2 wherein the damping unit includes a damper securely fixed to the rocker and the housing.

6. The chain hoist of claim 5 wherein the damper is an element selected from the group consisting of metallic pad, spring damper and hydraulic damper.

7. The chain hoist of claim 2 wherein the rocker is swingably mounted to the housing via the damping element and the pivot axle.

8. The chain hoist of claim 1 wherein the at least one of the plurality of sprockets is constituted by the first one of the sprockets which is supported by the load-bearing member via the damping unit.

9. A chain hoist, comprising:

a carrier;

a chain mounted to the carrier and guided via a plurality of sprockets to a load-bearing member;

a drive unit having a housing and a driveshaft accommodated in the housing and interacting with a first one of the sprockets for operating the chain, wherein a second one of the sprockets is disposed immediately following the first one of the sprockets in load direction;

a damping unit, wherein the housing and the first sprocket form with the first and second ones of the sprockets a structural unit; and a rocker supporting the structural unit, with one end of the rocker swingably mounted to the carrier and another end supported via the damping unit by the carrier.

10. The chain hoist of claim 9 wherein the carrier is track-bound.

* * * * *